United States Patent [19]

Petit et al.

[11] Patent Number: 4,939,032

[45] Date of Patent: Jul. 3, 1990

[54] COMPOSITE MATERIALS HAVING IMPROVED FRACTURE TOUGHNESS

[75] Inventors: Jocelyn I. Petit, New Kensington; Philip E. Bretz, Plum Boro, both of Pa.; Henry G. Paris, San Diego; Ralph R. Sawtell, Lafayette, both of Calif.; Diana K. Denzer, Lower Burrell, Pa.

[73] Assignee: Aluminum Company of America, Pittsburgh, Pa.

[21] Appl. No.: 66,180

[22] Filed: Jun. 25, 1987

[51] Int. Cl.[5] ..... B32B 5/16; C22C 21/00

[52] U.S. Cl. ..... 428/328; 428/323; 428/546; 428/567; 75/230; 75/232; 148/11.5 A; 148/11.5 P; 148/11.5 Q; 148/127; 148/437; 148/902; 420/550

[58] Field of Search ..... 75/232–235, 75/230; 428/323, 546, 567, 328; 148/11.5 A, 11.5 P, 11.5 Q, 902, 437, 127; 420/550

[56] References Cited

U.S. PATENT DOCUMENTS

| | | | |
|---|---|---|---|
| 3,000,339 | 9/1961 | Coxe . | |
| 3,393,056 | 7/1968 | Zdanuk et al. . | |
| 3,427,154 | 2/1969 | Mader et al. . | |
| 3,438,753 | 4/1969 | Kenney et al. . | |
| 3,649,257 | 3/1972 | Fletcher . | |
| 3,669,634 | 6/1972 | Peters et al. . | |
| 3,796,553 | 3/1974 | Daunt . | |
| 3,816,080 | 6/1974 | Bomford et al. . | |
| 3,817,746 | 6/1974 | Tsuei . | |
| 3,838,982 | 10/1974 | Sanderow et al. . | |
| 4,008,079 | 2/1977 | Bowers . | |
| 4,053,011 | 10/1977 | Riewald et al. . | |
| 4,104,062 | 8/1978 | Weaver | 75/249 |
| 4,259,112 | 3/1981 | Dolowy, Jr. et al. . | |
| 4,444,603 | 4/1984 | Yamatsuta et al. . | |
| 4,450,207 | 5/1984 | Donomoto et al. . | |
| 4,452,865 | 6/1984 | Yamatsuta et al. . | |
| 4,457,979 | 7/1984 | Donomoto et al. . | |
| 4,475,983 | 10/1984 | Bader et al. . | |
| 4,597,792 | 7/1986 | Webster . | |
| 4,693,747 | 9/1987 | Bretz et al. | 75/249 |
| 4,743,317 | 5/1988 | Skinner et al. | 75/249 |

*Primary Examiner*—George F. Lesmes
*Assistant Examiner*—Christopher W. Brown
*Attorney, Agent, or Firm*—Daniel A. Sullivan, Jr.; Douglas P. Mueller

[57] ABSTRACT

Composite materials having improved fracture toughness are formed by dispersing ductile inclusions in a less ductile matrix. The matrices may be formed from metals, such as high-strength aluminum alloys or ceramics. Bonding should be present between the inclusions and the matrix so that cracks in the composite material must pass through the inclusions.

11 Claims, 5 Drawing Sheets

UNIT PROPAGATION ENERGY AS A FUNCTION OF YIELD STRENGTH, 1.60 mm (0.063 in.) SHEET

COMPOSITE MATERIALS HAVING IMPROVED FRACTURE TOUGHNESS

BACKGROUND OF THE INVENTION

The present invention is directed to composite materials formed of a matrix and inclusions within the matrix. The material forming the inclusions has a ductility which is greater than that of the material forming the matrix. Ductility may be considered as the resistance to fracture exhibited by a given material. The provision of such ductile inclusions results in a material having increased fracture toughness. Although the invention is generally concerned with metals, and especially aluminum alloys, the present invention also is applicable to other materials, such as ceramics.

Certain materials exhibit properties of great interest, such as high strength, corrosion resistance, etc., but suffer from brittleness. Examples of such materials include high strength ceramics for engine components and certain high strength aluminum alloys. The fracture toughness of such materials can be improved by utilizing these materials as a matrix and providing a dispersion of ductile islands (inclusions) within the matrix. It is therefore an object of this invention to provide composite materials which have the desired properties of the base material as well as improved fracture toughness.

DETAILED DESCRIPTION OF THE INVENTION

Figure 1:
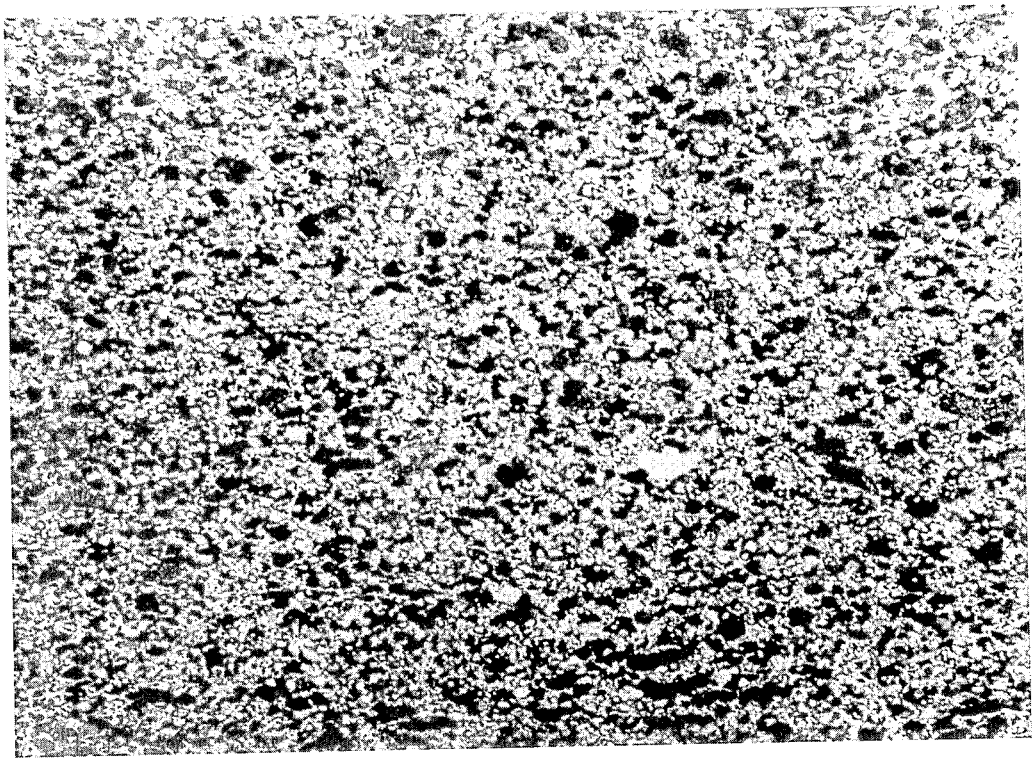
FIGS. 1-4 are 100×magnification optical micrographs of the microstructures of an Al-8 wt. % Fe-4 wt % Ce alloy matrix having 0%, 5%, 10% and 20% pure aluminum included therein respectively.
Figure 2:
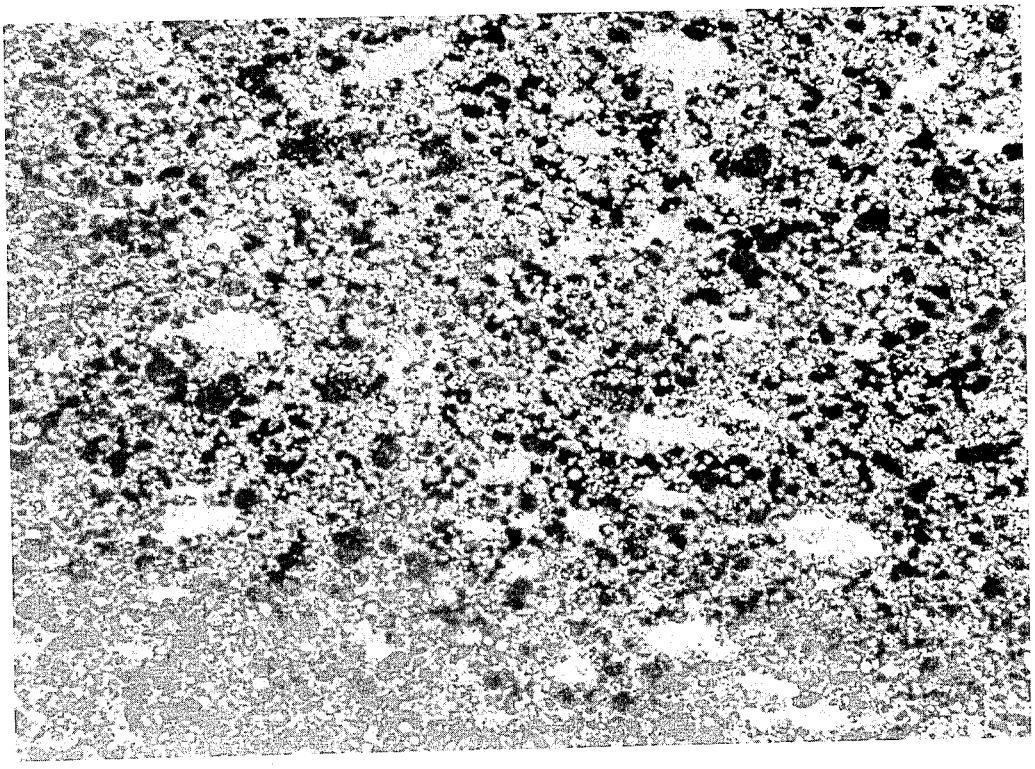
Figure 3:
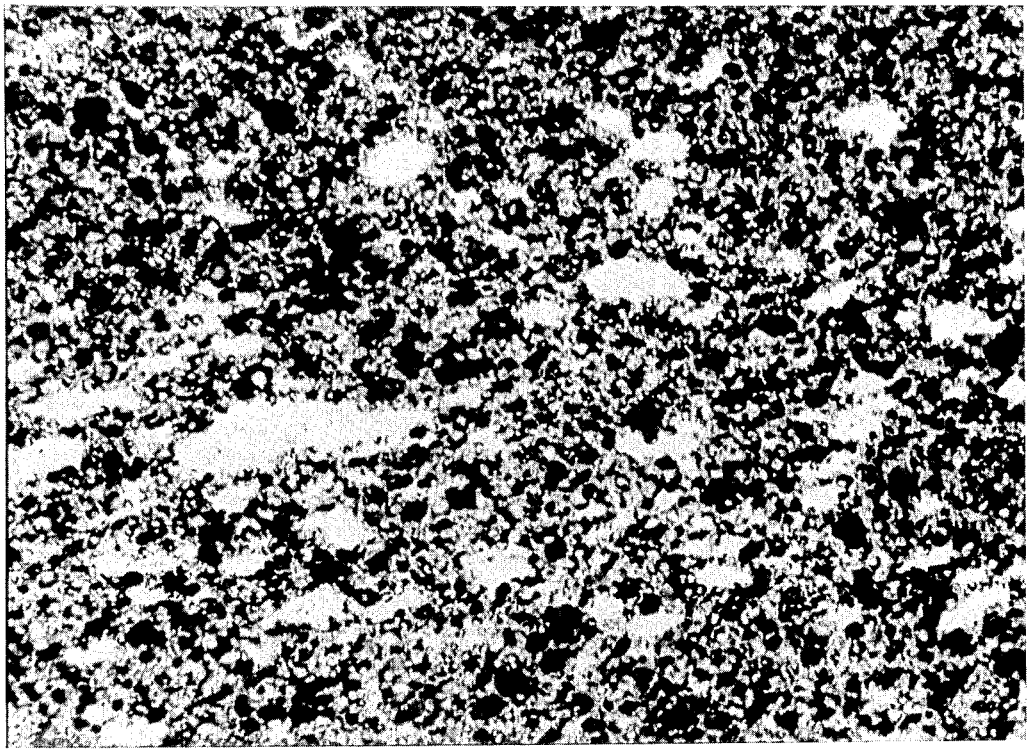
Figure 4:
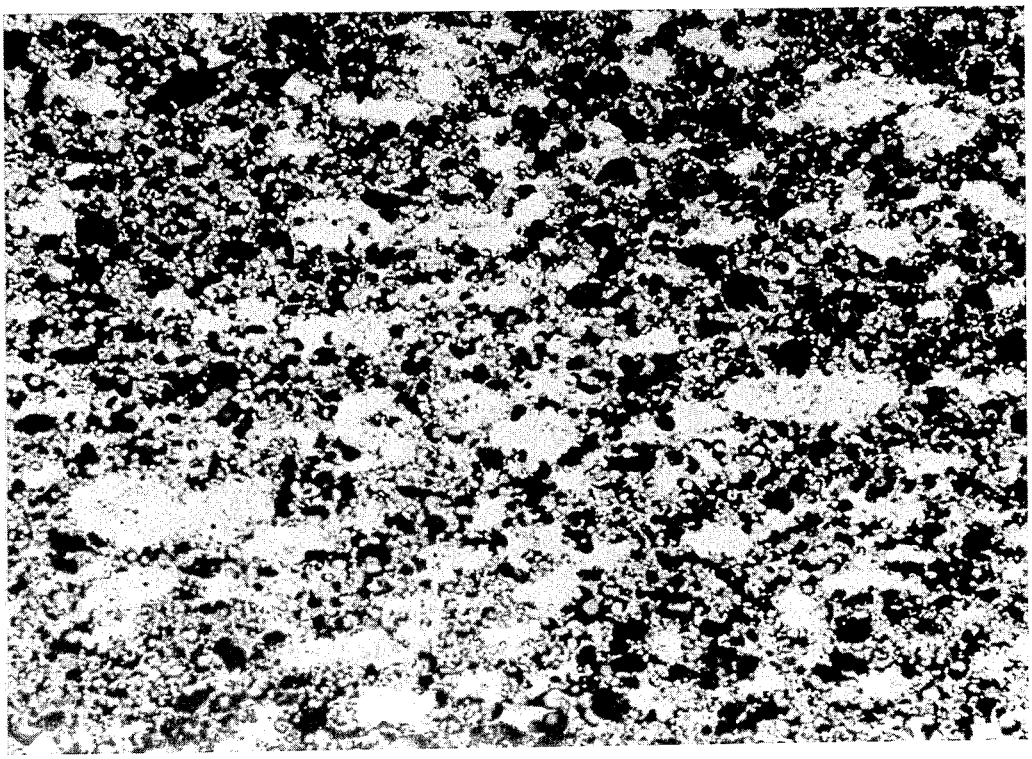
Figure 5:
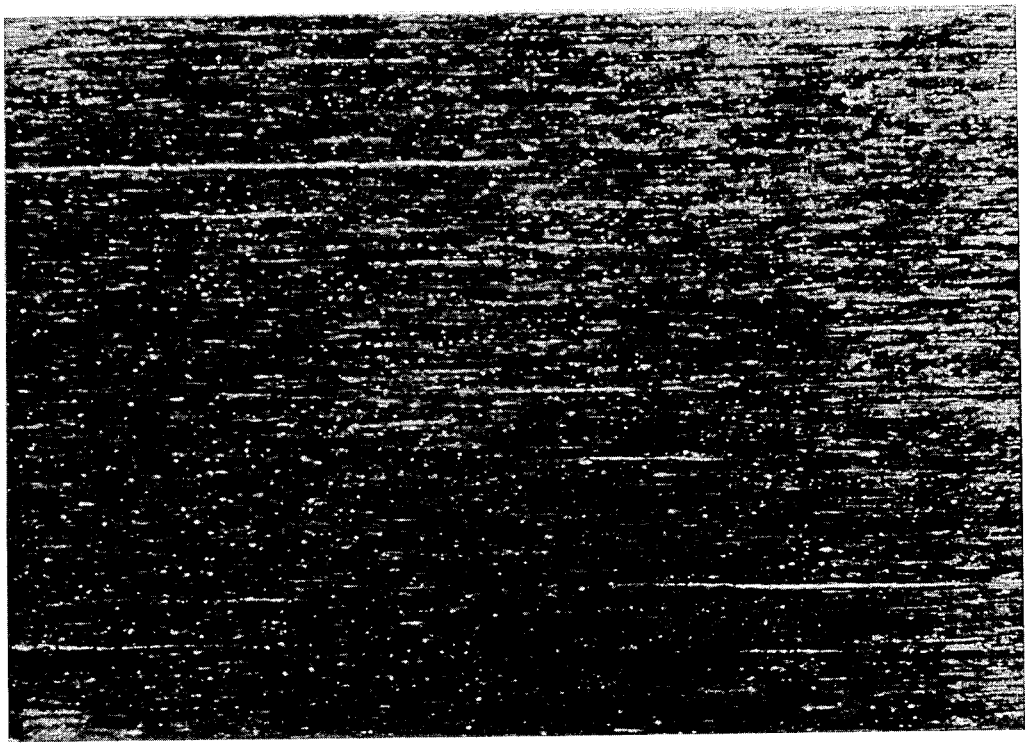
FIGS. 5-8 are similar to FIGS. 1-4, but show the materials after extrusion.
Figure 6:
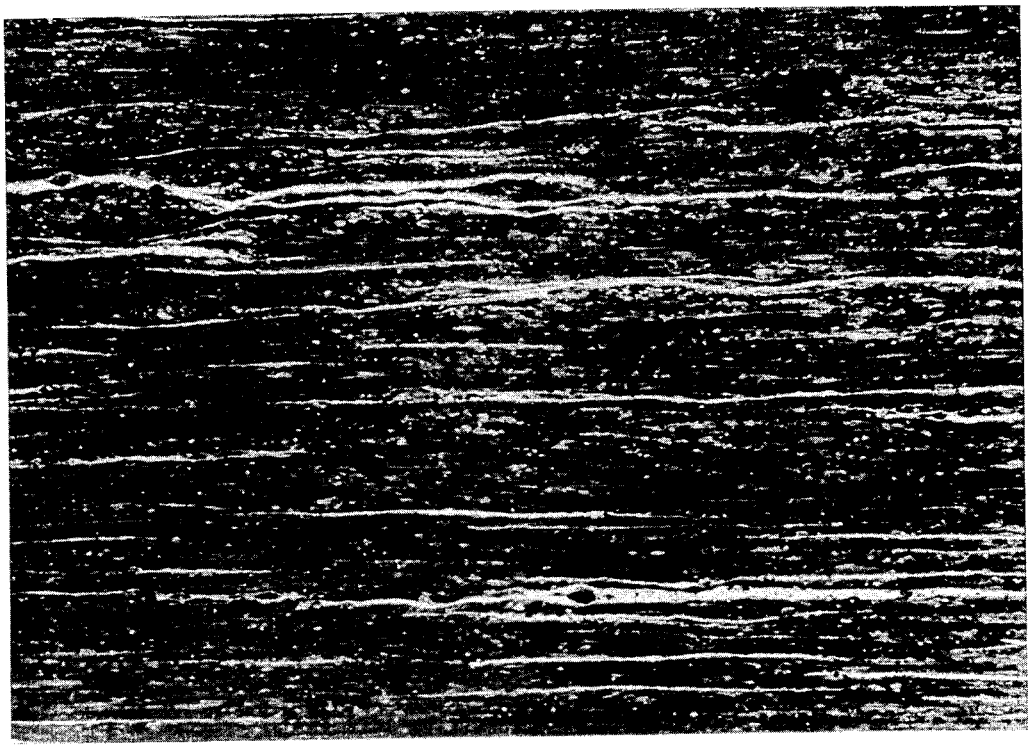
Figure 7:
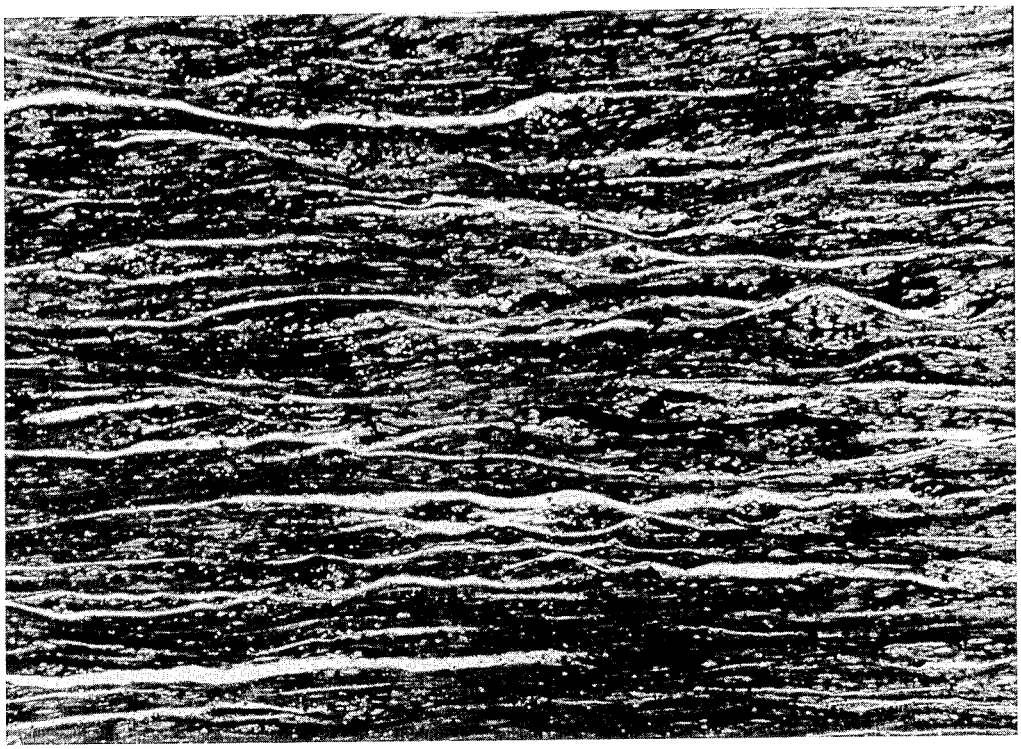
Figure 8:
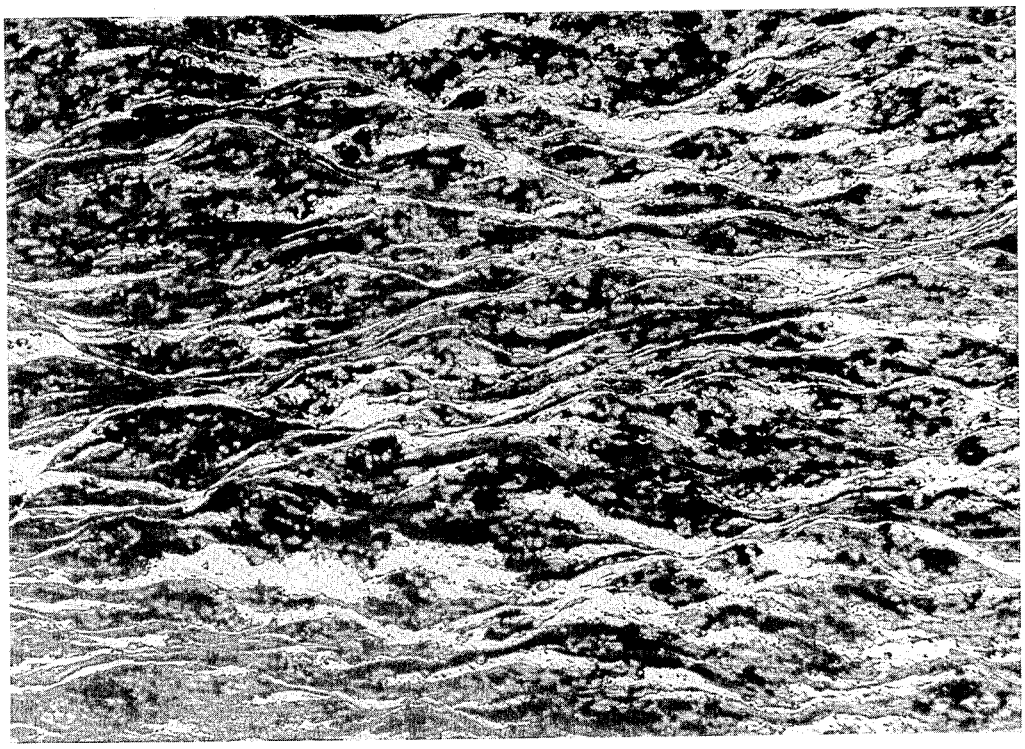

The present invention relates to composite materials formed of a matrix having certain desired properties and inclusions within the matrix having a ductility greater than the ductility of the matrix material. This provides the composite material with a fracture toughness which is improved over that of the matrix material alone.

The present invention is not limited to any particular matrix material, and materials such as ceramics and metals may be used as the matrix. The present invention is particularly useful with aluminum-based metal matrices, particularly high strength aluminum alloys. Examples of such alloys include the 7000 series of alloys. Such alloys include, for example, 8-12 weight percent Zn. 1.5-2.5 weight percent Mg, 0-1.5% Cu and 0-2% Co, especially 10-12.5% Zn, about 2.4% Mg, about 1-1.2% Cu and about 1.6% Co. Another example of such an alloy includes Al, about 5-10% Fe, and about 2-5% Ce, especially about 8% Fe and about 4% Ce. Any of the alloys discussed herein may include minor (less than 1%) amounts of impurities such as Si, Be, Fe (when not used as an alloying agent), etc.

The material forming the inclusions has a ductility greater than that of the matrix material, and thus the identity of the inclusion material is determined in some respects by the identity of the matrix material. Thus, when one of the high strength aluminum alloys mentioned above is used, the inclusion material might be a more ductile aluminum alloy or even substantially pure (commerical grade, for example) aluminum. In the case of the Al-Fe-Ce alloy mentioned above, an alloy containing lesser amounts of Fe and Ce (2-5% Fe and 1-3% Ce, for example) may be used. The inclusion material may be present in amounts of up to 40% by weight of the composite material, although it has been found that it is desirable to use 5-20%, especially about 10-15%. The amount of the inclusion material should be sufficient so that the areas of inclusions are not too widely separated to prevent improved toughness in the final material.

To increase the fracture toughness, bonding should be present between the matrix material and the inclusion material. In the presence of such bonding, cracks in the matrix material are forced to go through the inclusion material. In the absence of such bonding, a crack may propagate along the interface between the inclusion and the matrix, without passing through the inclusion, thus bypassing the ductile inclusion and the crack-inhibiting properties provided by the inclusion. Although it is necessary for the inclusion material to have a greater ductility than that of the matrix material, to promote bonding the difference in ductilities should not be too great. If the difference in ductilities is too great, the inclusion material may deform during processing to a much greater degree than the matrix material, which will provide poor bonding.

The desired strength differential for proper bonding between the starting matrix material and the starting inclusion material will depend on many factors. Factors such as the specific alloy compositions of the powders, the surface characters of the powders and the volume fractions blended together will be important. For example, if pure aluminum powder is mixed into 7XXX (7000-series aluminum alloys) powder, although the initial strength difference is great, diffusion of strengthening elements will take place during compaction, reducing the actual strength difference.

The composite materials of this invention may be made by any suitable method, as long as the inclusions remain discrete and evenly dispersed throughout the matrix. When metals are used, it is preferred to prepare the materials by a known powder blending and compacting technique, although other methods such as casting might also be used. In the case of metals, such as aluminum-based metals, appropriate amounts of matrix and inclusion powders may be blended in a conventional machine, such as a V-type blender. After blending for a sufficient time to ensure uniform dispersion (for example, 30 minutes), the blended powder can be subjected to standard cold compacting, for example at a pressure of 207 MPa. The cold compacts can be canned by standard methods and vacuum preheated to obtain a temperature of about 700° F. and a pressure of less than 40 μm in about a 4-hour cycle time. Hot pressing can then be conducted at a temperature of 700° F. using a 1 minute dwell time at a pressure of 620 MPa. The above process is well known in the art of powder metallurgy. The values listed are suitable for an Al-Fe-Ce alloy. Those skilled in the art will recognize that the values will vary depending on the material being processed. For example, temperatures higher than 700° F. will be used for Al-Zn-Mg alloys. The billet thus-obtained can be subjected to further processing, such as extrusion into a desired bar shape. The presence of the inclusion material lessens the press load needed for breakout during extrusion and may act as an internal lubricant for the composite material.

The powders may have a particle size of +325 to −100 mesh. The particles may be substantially the same size, although some advantages may inhere from using coarser inclusion particles, as disclosed in Bretz et al., Serial No. 799,024 filed Nov. 18, 1985, now U.S. Pat. No. 4,693,747, the disclosure of which is incorporated herein by reference.

FIGS. 1, 2, 3 and 4 are optical micropgraphs of samples of Al-8% Fe-4% Ce alloy powder, blended with 0, 5, 10 and 20 percent by weight pure commerical grade aluminum powder respectively, and processed according to a procedure similar to that described above. The inclusions of pure aluminum show as the relatively large white spaces in FIGS. 2–4. FIGS. 5–8 are optical micrographs of the materials of FIGS. 1–4, after extrusion. Again, the aluminum inclusions appear as relatively thick white bands. It should be noted that this material did not exhibit improved fracture toughness because of inadequate bonding between the inclusions and the matrix, but the figures are useful to show the despersion of the inclusions within the matrix.

Figure 9:
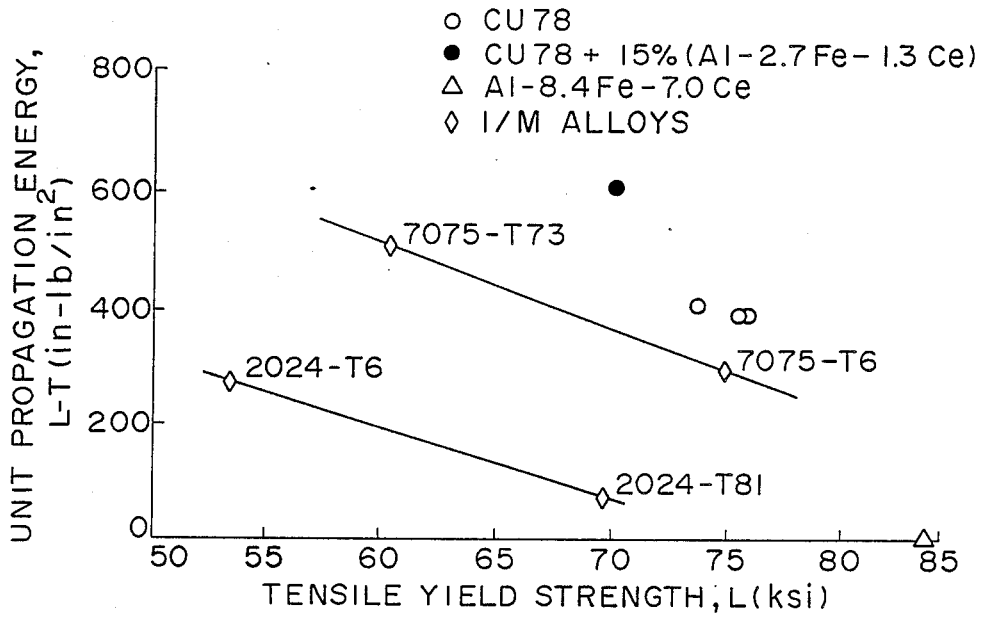
FIG. 9, shows a plot of fracture toughness versus tensile yield strength for several alloys.

FIG. 9 shows a plot of fracture toughness versus tensile yield strength for several aluminum-based alloys, including two ingot metallurgy alloys, an Al-8.4-Fe-7.0Ce powder metallurgy alloy and CU78 alloy (Al-8.3Fe-4Ce). Also plotted is the fracture toughness and tensile yield strength value for a blend of CU78 with 15% by weight of an Al-2.7Fe-1.3Ce alloy. It can be seen that the blended alloy exhibits significantly increased toughness while retaining the high tensile strength of the matrix.

Further tests were conducted on various blends of an Al-8% Fe-4% Ce alloy, extruded into a 1"×3" bar, and the results are reproduced below. The blends were prepared and compacted according to a process like that described above.

| Blend | Yield Strength, ksi | Toughness, $K_Q$, ksi $\sqrt{in}$ |
|---|---|---|
| 0% pure Al | 58.9 | 13.0 |
| 5% pure Al | 54.2 | 14.7 |
| 10% pure Al | 51.8 | 22.4 |
| 20% pure Al | 40.5 | 20.8 |

| Blend | Yield Strength, ksi | Fracture Toughness, $K_Q$, ksi $\sqrt{in}$ |
|---|---|---|
| No blend | 55.8 | 11.6 |
| 15% Al—5.3Fe—2.7Ce | 54.3 | 15.2 |
| 15% Al—2.7Fe—1.3Ce | 50.9 | 21.3 |
| 15% Pure Al | 45.4 | 20.2 |

Similar tests were conducted on various blends of Al-Zn-Mg-Cu-Co alloys, and the results are shown below.

TABLE I

ATOMIZED POWDERS

| Alloy | S. No. | Pot. No. | | Composition (Wt. %) Zn | Mg | Cu | Co | Fe | Si | Be |
|---|---|---|---|---|---|---|---|---|---|---|
| A | — | — | Target | 12.5 | 2.4 | 1.2 | 1.6 | — | — | — |
| | 514206 | 2613 | Actual | 12.4 | 2.37 | 1.21 | 1.57 | .07 | .04 | .002 |
| | 514203 | 2610 | Actual | 12.4 | 2.37 | 1.20 | 1.51 | .09 | .04 | .002 |
| B | — | — | Target | 10.6 | 2.0 | 1.0 | 1.6 | — | — | — |
| | 514204 | 2611 | Actual | 10.6 | 1.98 | 1.07 | 1.55 | .04 | .07 | .002 |
| C | — | — | Target | 12.5 | 2.4 | 1.2 | 0.4 | — | — | — |
| | 514201 | 2608 | Actual | 12.4 | 2.34 | 1.20 | 0.38 | .07 | .05 | .002 |
| D | — | — | Target | 0 | 0 | 0 | 1.6 | — | — | — |
| | 514210 | 2617 | Actual | 0.04 | .00 | .00 | 1.52 | .04 | .01 | — |
| E | — | — | Target | 10.6 | 2.0 | 1.0 | 0 | — | — | — |
| | 514207 | 2614 | Actual | 10.8 | 2.00 | 1.03 | .00 | .04 | .05 | .002 |
| F | — | — | Target | 0 | 0 | 0 | 0.2 | — | — | — |
| | 514208 | 2615 | Actual | 0.04 | .00 | .00 | 0.21 | .03 | .04 | — |
| Pure Al | 514090 | 2508 | Target | 0 | 0 | 0 | 0 | — | — | — |

TABLE II

BILLETS PRODUCED

| Billet No. | S. No. | Alloys Blended |
|---|---|---|
| 1 | 553802 | 100% A |
| 2 | 514204 | 100% B |
| 3 | 514201 | 100% C |
| 4 | 553803 | 85% A + 15% Pure Al |
| 5 | 553804 | 85% C + 15% Pure Al |
| 6 | 553805 | 85% A + 15% D |
| 7 | 553806 | 85% B + 15% E |
| 8 | 553807 | 85% A + 15% F |

TABLE III

TENSILE AND TOUGHNESS DATA FOR BLENDED EXTRUSIONS
(All Data Represents Average of Duplicate Tests)

| S. No. | Billet No. | Tensile Data Orient. | Y.S. (ksi) | Y.S. (MPa) | T.S. (ksi) | T.S. (MPa) | Elong. (%) | R of A (%) | Toughness Data Orient. | $K_Q$ (ksi $\sqrt{in.}$) |
|---|---|---|---|---|---|---|---|---|---|---|
| 553802 | 1 | L | 97.6 | 672 | 102 | 703 | 9.5 | 15 | L-T | 14.5 (2) |
| | | T | 89.0 | 613 | 95.6 | 659 | 9.0 | 10 | | |
| 514204 | 2 | L | 90.1 | 621 | 95.2 | 656 | 12.5 | 17 | L-T | 23.0 (1) |
| | | T | 82.3 | 567 | 89.0 | 613 | 9.5 | 12 | | |
| 514201 | 3 | L | 98.4 | 678 | 102 | 706 | 10 | 8 | L-T | 16.5 (4) |
| | | T | 88.9 | 613 | 95.3 | 657 | 6.5 | 8 | | |
| 553803 | 4 | L | 93.1 | 642 | 97.4 | 671 | 11.5 | 15 | L-T | 22.2 (1) |

TABLE III-continued

TENSILE AND TOUGHNESS DATA FOR BLENDED EXTRUSIONS
(All Data Represents Average of Duplicate Tests)

| S. No. | Billet No. | Tensile Data Orient. | Y.S. (ksi) | Y.S. (MPa) | T.S. (ksi) | T.S. (MPa) | Elong. (%) | R of A (%) | Toughness Data Orient. | $K_Q$ (ksi $\sqrt{\text{in.}}$) |
|---|---|---|---|---|---|---|---|---|---|---|
| | | T | 84.4 | 582 | 90.8 | 626 | 10.5 | 17 | | |
| 553804 | 5 | L | 92.1 | 635 | 96.5 | 665 | 12 | 15 | L-T | 31.0 (1) |
| | | T | 83.7 | 577 | 89.8 | 619 | 10 | 14 | | |
| 553805 | 6 | L | 93.2 | 643 | 97.9 | 675 | 12 | 15 | L-T | 20.4 (3) |
| | | T | 85.8 | 591 | 91.8 | 633 | 7 | 9 | | |
| 553806 | 7 | L | 93.7 | 646 | 98.1 | 676 | 11.0 | 16 | L-T | 23.6 (1) |
| | | T | 85.8 | 591 | 91.8 | 632 | 9.5 | 12 | | |
| 553807 | 8 | L | 93.5 | 645 | 97.9 | 675 | 11 | 13 | L-T | 20.7 (1) |
| | | T | 85.9 | 592 | 92.0 | 634 | 11 | 17 | | |

NOTES:
(1) Both tests valid for $K_{Ic}$.
(2) Both tests invalid for $K_{Ic}$.
(3) One test valid, one test meaningful.
(4) One test invalid, one test meaningful.

In case of the blend designated billet nos. 7 and 8, the key factor is that the inclusions (second phase) have a lower level of incoherent Co-containing dispersoid than the matrix. Cobalt is necessary in the matrix to retain the desired overall fine unrecrystalized grain structure. However, under stress, voids can form at the interface between the cobalt dispersoid and the matrix, leading to void coalescence and fracture. Thus, the low cobalt regions have a higher ductility as compared with the matrix.

Although a detailed description has been provided above and specific examples have been set forth, modifications will be apparent to those skilled in the art, and the present invention is not limited to the above description and examples, but rather is defined in the following claims.

What is claimed is:

1. A composite material having an improved fracture toughness, formed of a matrix and areas of inclusions within the matrix, the matrix being formed of a first high strength aluminum alloy which consists essentially of aluminum, iron and cerium, the inclusions being formed from a material having a greater ductility than that of the first alloy, there being sufficient bonding between the matrix and the inclusions so that a crack propagating in the composite material is forced to pass through at least one inclusion.

2. The composite material of claim 1, wherein the first alloy contains about 8% iron and about 4% cerium.

3. The composite material of claim 1, wherein the inclusions are metal.

4. The composite material of claim 3, wherein the inclusions are formed from substantially pure aluminum or an aluminum alloy more ductile than said first alloy.

5. The composite material of claim 4, wherein the inclusions are formed from a second alloy which consists essentially of aluminum, iron and cerium, the second alloy having a higher aluminum content than said first alloy.

6. The composite material as claimed in claim 1, wherein the opposite material is formed from blended and compressed powders.

7. The composite material of claim 6, wherein the particle size of the powders is less than 100 mesh.

8. The composite material of claim 7, wherein the powders of the matrix and inclusion materials are of substantially equal particle size.

9. The composite material of claim 1, wherein the inclusions are present in an amount of not more than about 40% by weight.

10. The composite material of claim 9, wherein the amount is about 5–20% by weight.

11. The composite material of claim 10, wherein the amount is about 10–15% by weight.

* * * * *

UNITED STATES PATENT AND TRADEMARK OFFICE

CERTIFICATE OF CORRECTION

PATENT NO. : 4,939,032

DATED : July 3, 1990

INVENTOR(S) : Jocelyn I. Petit et al.

It is certified that error appears in the above-identified patent and that said Letters Patent is hereby corrected as shown below:

| | |
|---|---|
| Col. 3, line 10 | Change "micropgraphs" to --micrographs--. |
| Col. 3, line 12 | Change "commerical" to --commercial--. |
| Col. 3, line 22 | Change "despersion" to --dispersion--. |
| Col. 3, line 55 | Change "reproducted" to --reproduced--. |
| Col. 5, line 21 | Change "In case" to --In the case--. |
| Claim 6, Col. 6, line 33 | Change "opposite" to --composite--. |

Signed and Sealed this

Third Day of March, 1992

*Attest:*

HARRY F. MANBECK, JR.

*Attesting Officer*

*Commissioner of Patents and Trademarks*